US008522881B2

(12) United States Patent
Worrall et al.

(10) Patent No.: US 8,522,881 B2
(45) Date of Patent: Sep. 3, 2013

(54) THERMAL HYDRATE PREVENTER

(75) Inventors: Robert Worrall, Naples, FL (US); Craig Hazelton, Lafayette, CO (US); Michael Tupper, Lafayette, CO (US)

(73) Assignee: Composite Technology Development, Inc., Lafayette, CO (US)

( * ) Notice: Subject to any disclaimer, the term of this patent is extended or adjusted under 35 U.S.C. 154(b) by 0 days.

(21) Appl. No.: 13/462,590

(22) Filed: May 2, 2012

(65) Prior Publication Data

US 2013/0118754 A1 May 16, 2013

Related U.S. Application Data

(60) Provisional application No. 61/488,083, filed on May 19, 2011.

(51) Int. Cl.
*E21B 37/06* (2006.01)
*E21B 43/01* (2006.01)

(52) U.S. Cl.
USPC ..... 166/344; 166/363; 166/364; 166/304; 166/60; 166/75.13; 405/224.3

(58) Field of Classification Search
USPC ..... 166/344, 338, 345, 351, 352, 363, 166/364, 367, 302–304, 378–380, 57, 60, 166/61, 97.1, 75.13; 405/158, 184.4, 224.2, 405/224.3; 414/137.5
See application file for complete search history.

(56) References Cited

U.S. PATENT DOCUMENTS 3,291,636 A 12/1966 Reighter et al.
3,548,605 A * 12/1970 Armistead et al. ..... 405/60
3,643,741 A * 2/1972 Miranda ..... 166/295
3,653,215 A * 4/1972 Crucet ..... 405/60
3,658,181 A * 4/1972 Blair ..... 210/170.05
3,664,136 A * 5/1972 Laval et al. ..... 405/60
3,724,662 A * 4/1973 Ortiz ..... 405/65
3,745,773 A * 7/1973 Cunningham ..... 405/60

(Continued)

FOREIGN PATENT DOCUMENTS

DE 2 335 391 A1 2/1974

OTHER PUBLICATIONS

Author Unknown, "Another look at an old source," Associated Press, Oct. 4, 2005, [retrieved on Nov. 4, 2005}, 2 pages. Retrieved from: http://www.dailycamera.com/bdc/national_intl_business/article/0,1713,BDC_2464_4129743,00.html.

(Continued)

*Primary Examiner* — Matthew Buck

(74) *Attorney, Agent, or Firm* — Kilpatrick Townsend & Stockton LLP

(57) ABSTRACT

Systems and methods for the prevention or dissolution of hydrates in an undersea well. One example system includes a submersible isolation bell for capturing effluent being exhausted from the well, and an umbilical. A power cable supplies electric power to the submersible isolation bell, for example for heating of the interior of the submersible isolation bell to prevent or discourage the formation of methane hydrates and the precipitation of other byproducts. Diluents may be supplied to the submersible isolation bell to further discourage the formation of hydrates and precipitation of other byproducts. The diluents may be heated locally at the submersible isolation bell, using electric power supplied by the power cable. A conformable seal may substantially seal the submersible isolation bell to a riser or other structure at the wellhead.

17 Claims, 11 Drawing Sheets

(56) References Cited

U.S. PATENT DOCUMENTS

| | | | | | |
|---|---|---|---|---|---|
| 3,879,951 | A * | 4/1975 | Mason | 405/60 |
| 3,981,154 | A * | 9/1976 | Hix, Jr. | 405/60 |
| 4,004,635 | A | 1/1977 | Marquaire et al. | |
| 4,269,639 | A | 5/1981 | Lewis | |
| 4,284,943 | A | 8/1981 | Rowe | |
| 4,290,714 | A * | 9/1981 | Strange | 405/60 |
| 4,317,003 | A | 2/1982 | Gray | |
| 4,318,442 | A * | 3/1982 | Lunde et al. | 166/357 |
| 4,323,118 | A * | 4/1982 | Bergmann | 166/96.1 |
| 4,324,505 | A * | 4/1982 | Hammett | 405/60 |
| 4,338,970 | A | 7/1982 | Krackeler et al. | |
| 4,358,218 | A * | 11/1982 | Graham | 405/60 |
| 4,358,219 | A * | 11/1982 | Burns | 405/60 |
| 4,382,716 | A * | 5/1983 | Miller | 405/60 |
| 4,395,157 | A * | 7/1983 | Cunningham | 405/60 |
| 4,416,565 | A * | 11/1983 | Ostlund | 210/170.11 |
| 4,421,436 | A * | 12/1983 | Burns | 405/223.1 |
| 4,440,523 | A * | 4/1984 | Milgram et al. | 210/170.11 |
| 4,449,850 | A * | 5/1984 | Cessou et al. | 405/60 |
| 4,456,071 | A * | 6/1984 | Milgram | 166/356 |
| 4,496,795 | A | 1/1985 | Konnik | |
| 4,531,860 | A * | 7/1985 | Barnett | 405/60 |
| 4,533,526 | A * | 8/1985 | Delacour et al. | 423/1 |
| 4,568,220 | A * | 2/1986 | Hickey | 405/60 |
| 4,570,715 | A | 2/1986 | Van Meurs et al. | |
| 4,572,299 | A | 2/1986 | VanEgmond et al. | |
| 4,619,762 | A * | 10/1986 | Delacour et al. | 210/170.11 |
| 4,622,116 | A | 11/1986 | Elton et al. | |
| 4,643,612 | A * | 2/1987 | Bergeron | 405/60 |
| 4,702,832 | A * | 10/1987 | Renfrow | 210/242.3 |
| 4,724,345 | A | 2/1988 | Elton et al. | |
| 4,790,936 | A * | 12/1988 | Renfrow | 210/242.3 |
| 4,822,434 | A | 4/1989 | Sawaki et al. | |
| 4,956,535 | A | 9/1990 | Buelt et al. | |
| 5,065,818 | A | 11/1991 | Van Egmond | |
| 5,154,835 | A | 10/1992 | DeMichael | |
| 5,172,765 | A | 12/1992 | Sas-Jaworsky et al. | |
| 5,213,444 | A * | 5/1993 | Henning | 405/63 |
| 5,560,536 | A | 10/1996 | Moe | |
| 5,658,473 | A | 8/1997 | Ziemek | |
| 6,397,945 | B1 | 6/2002 | Manke et al. | |
| 6,407,339 | B1 | 6/2002 | Rice et al. | |
| 6,523,610 | B1 | 2/2003 | Griffith et al. | |
| 6,540,018 | B1 | 4/2003 | Vinegar et al. | |
| 6,759,592 | B1 | 7/2004 | Cai et al. | |
| 6,761,574 | B1 | 7/2004 | Song et al. | |
| 6,769,485 | B2 | 8/2004 | Vinegar et al. | |
| 6,777,965 | B1 | 8/2004 | Mess | |
| 7,040,397 | B2 | 5/2006 | De Rouffignac et al. | |
| 7,311,151 | B2 | 12/2007 | Chitwood et al. | |
| 7,892,597 | B2 | 2/2011 | Hooker et al. | |
| 7,987,903 | B1 * | 8/2011 | Prado Garcia | 166/75.13 |
| 8,016,030 | B1 * | 9/2011 | Prado Garcia | 166/75.13 |
| 8,025,103 | B1 * | 9/2011 | Wolinsky | 166/364 |
| 8,186,443 | B2 * | 5/2012 | Wolinsky | 166/364 |
| 8,196,665 | B2 * | 6/2012 | Wolinsky | 166/356 |
| 8,205,678 | B1 * | 6/2012 | Milanovich | 166/364 |
| 8,297,361 | B1 * | 10/2012 | Root | 166/364 |
| 8,322,437 | B2 * | 12/2012 | Brey | 166/363 |
| 2001/0035764 | A1 | 11/2001 | Mess | |
| 2002/0129945 | A1 | 9/2002 | Brewer et al. | |
| 2002/0158064 | A1 | 10/2002 | Spencer | |
| 2003/0037927 | A1 | 2/2003 | Dalrymple et al. | |
| 2003/0124030 | A1 | 7/2003 | Birdsall et al. | |
| 2004/0134662 | A1 | 7/2004 | Chitwood et al. | |
| 2004/0144541 | A1 | 7/2004 | Picha et al. | |
| 2005/0006097 | A1 | 1/2005 | Sandberg et al. | |
| 2005/0029476 | A1 | 2/2005 | Biester et al. | |
| 2005/0092483 | A1 | 5/2005 | Vinegar et al. | |
| 2005/0179152 | A1 | 8/2005 | Bauer et al. | |
| 2007/0181306 | A1 | 8/2007 | Tupper et al. | |
| 2007/0199709 | A1 | 8/2007 | Hooker et al. | |
| 2010/0051279 | A1 * | 3/2010 | Baugh et al. | 166/302 |
| 2011/0274496 | A1 * | 11/2011 | Dvorak | 405/64 |
| 2011/0293372 | A1 * | 12/2011 | Later | 405/60 |
| 2012/0006444 | A1 | 1/2012 | Tupper et al. | |
| 2012/0087729 | A1 * | 4/2012 | Oesterberg et al. | 405/60 |
| 2012/0125623 | A1 * | 5/2012 | Cargol et al. | 166/344 |
| 2012/0247784 | A1 * | 10/2012 | Lacy | 166/363 |
| 2012/0325489 | A1 * | 12/2012 | Beynet et al. | 166/353 |
| 2013/0046126 | A1 * | 2/2013 | Varney et al. | 588/260 |

OTHER PUBLICATIONS

Author Unknown, "Mineral Insulated Heating Cables," Tyco Thermal Controls, Jan. 2005, 16 pages.

Author Unknown, "Appendix J: Engineering Specification for Electrical Heat-Tracing Systems," Tyco Thermal Controls, Aug. 2003, 11 pages.

Author Unknown, "Editorial: Oil shale's potential looms large, later," DenverPost.com, 2 pages, No date.

Author Unknown, "Editorial: Riding the coattails of Katrina," DenverPost.com, [retrieved Oct. 3, 2005], 1 page. Retrieved from: http://www.denverpost.com/portlet/article/html/fragments/print_article.jsp?article=3084166.

Author Unknown, "Legislators hope Senate will alter oil shale proposal," Associated Press, Oct. 27, 2005, [retrieved on Nov. 4, 2005], 1 page. Retrieved from: http://www.dailycamera.com/bdc/state_news/article/0,1713,BDC_2419_4190279,00.html.

Author Unknown, "MI Heating Cable—Alloy 825," Tyco Thermal Controls, Jan. 2005, 5 pages.

Author Unknown, "Mineral Insulated Cables," Tyco Thermal Controls, no date, 2 pages.

Author Unknown, "Oil shale:more trouble than worth?" Associated Press, Oct. 5, 2005, [retrieved on Nov. 4, 2005], 2 pages. Retrieved from: http://www.dailycamera.com/bdc/national_intl_business/article/0,1713,BDC_2464_4132585,00.html.

Author Unknown, "Shell takes next step in oil shale testing project," Associated Press, Aug. 20, 2005, [retrieved on Nov. 4, 2005], 1 page. Retrieved from: http://www.dailycamera.com/bdc/national_intl_business/article/0,1713,BDC_2464_4015764,00.html.

Bartis, J., et al., "Summary " *Oil Shale Development in the United States*, RAND Infrastructure, Safety, and Environment, RAND Corporation, 2005, 10 pages.

Bunger, J., "Exploration of oil shale needs federal prodding," no date, 1 page.

Chakrabarty, G., "Betting on Shale," Rocky Mountain News, no date, 2 pages.

Chakrabarty, G., "Shale's new hope," Rocky Mountain News, Oct. 18, 2004, 2 pages.

Cooke, S., "Defense official: US could be new energy center," Associated Press, Oct. 19, 2005, [retrieved on Nov. 4, 2005], 1 page. Retrieved from: http://www.dailycamera.com/bdc/state_news/article/0,1713,BDC_2419_4172329,00.html.

Denning, D., "Stinky Water, Sweet Oil . . . The Last Word," 2 Pages, No date.

Fabian, P., et al., "Electrical Insulation Systems for the ITER Central Solenoid Model Coil", IEEE Transactions on Applied Superconductivity, 1999, vol. 9, No. 2, pp. 632-635.

Foy, P., "Oil riches just out of reach," DenverPost.com, no date, 4 pages.

Fumento, M., "Guzzle away! Oil sands will save us," Scripps Howard News Service, Oct. 29, 2005, [retrieved on Nov. 4, 2005], 2 pages. Retrieved from: http://www.dailycamera.com/bdc/opinion_columnists/article/0,1713,BDC_2490_4195580,00.html.

Gartner, E., "Industry scrounging for labor," Associated Press, Oct. 7, 2005, [retrieved on Nov. 4, 2005], 2 pages. Retrieved from: http://www.dailycamera.com/bdc/national_intl_business/article/0,1713,BDC_2464_4138778,00.html.

International Search Report and Written Opinion of PCT/US2007/003404 mailed on Sep. 26, 2007, 7 pages.

International Search Report and Written Opinion of PCT/US12/38364 mailed on Jul. 30, 2012, 9 pages.

Jayakumar, et al., "Testing of ITER Central Solenoid Coil Insulation in an Array", *16th IEEE/NPSS Symposium on Fusion Engineering*, vol. 2, 1995, pp. 1502-1505.

Johnson, H., et al., "Strategic Significance of America's Oil Shale Resource—vol. II," AOC Petroleum Support Service, LLC, Washington, D.C., Mar. 2004, 57 pages.

Kohler, J., "Oil extraction at what price," Associated Press, Oct. 8, 2005, [retrieved on Nov. 4, 2005], 2pages. Retrieved from: http://www.dailycamera.com/bdc/national_intl_business/article/0,1713,BDC_2464_4142034,00.html.

Lofholm, N., "Coal-mine rail sought at Mesa-Garfield line," Denver Post.com, 2 pages, No Date.

Reed, R., et al., "Development of U.S./ITER CS Model Coil Turn Insulation", *Advances in Cryogenic Engineering* (*Materials*), vol. 44, Plenum Press, NY, 1998, pp. 175-182.

Soraghan, M., "Bill aims to waive energy rules," DenverPost.com, no date, 2 pages.

Soraghan, M., "Companies seek oil-shale leases," DenverPost.com, no date, 1 page.

Talhelm, J., "Study touts oil shale," Associated Press, Sep. 1, 2005, [retrieved on Nov. 4, 2005], 1 page. Retrieved from: http://www.dailycamera.com/bdc/state_news/article/0,1713,BDC_2419_4045570,00.html.

Talhelm, J., "Canada's tar sands: 'Smell like money'," Associated Press, Oct. 6, 2005, [Retrieved on Nov. 4, 2005], 2 pages. Retrieved from: http://www.dailycamera.com/bdc/tech_plus/article/0,1713,BDC_2463_4135636,00.html.

Talhelm, J., "Caution urged wuth oil shale," Associated Press, no date, 1 page.

Trefny, J., "Energy act is a step in the right direction," DenverPost.com, no date, 2 pages.

Udall, R., "The Illusive Bonanza: Oil Shale in Colorado, "Pulling the Sword from the Stone"," no date, 5 pages.

* cited by examiner

THERMAL HYDRATE PREVENTER

CROSS REFERENCE TO RELATED APPLICATIONS

This is a non-provisional application that claims the benefit of commonly assigned U.S. Provisional Application No. 61/488,083, filed May 19, 2011, entitled "Thermal Hydrate Preventer," the entire disclosure of which is hereby incorporated by reference herein for all purposes.

BACKGROUND OF THE INVENTION

In certain circumstances, uncontrolled release of crude oil may occur from a subsea well. While careful steps are taken to avoid such uncontrolled release, once release occurs it is exceedingly important to move quickly and effectively to capture the oil being released to minimize environmental damage while further steps are taken to stop the flow of oil. Recent events have underscored the importance and difficulty of dealing with an uncontrolled subsea well.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

In some embodiments, a system for servicing an undersea well can include a submersible isolation bell for capturing effluent being exhausted from the well, and an umbilical. A power cable supplies electric power to the submersible isolation bell, for example, for heating of the interior of the submersible isolation bell to prevent and/or discourage the formation of methane hydrates and/or the precipitation of other byproducts. Diluents may be supplied to the submersible isolation bell to further discourage the formation of hydrates and/or precipitation of other byproducts. The diluents may be heated locally at the submersible isolation bell, using electric power supplied by the power cable. A conformable seal may substantially seal the submersible isolation bell to a riser or other structure at the wellhead.

In other embodiments, a method of servicing an undersea well includes providing a well servicing system that further includes a submersible isolation bell, and/or an umbilical connected to the submersible isolation bell. The umbilical further includes a collection conduit for carrying effluent from the well to a collection station. The umbilical may further include a power cable for transmitting electrical power to the submersible isolation bell. The system can be deployed by lowering the submersible isolation bell over the well and disposing the submersible isolation bell over the well.

According to other embodiments, a well servicing system can include an umbilical that includes a collection conduit for carrying effluent from the well to a collection station, at least one power cable, and/or a fitting connected to the umbilical. The fitting can be sized to fit within a piece of equipment at the wellhead. The system may further include a diluent carrying conduit for carrying diluent to the well. In some embodiments, the system may include an electric heater powered via the power cable and positioned to heat diluent in the diluent carrying conduit near a lower end of the umbilical. The system may also include a seal configured to deploy at the piece of equipment at the wellhead to substantially prevent effluent from escaping the well other than through the collection conduit.

According to other embodiments, a well servicing system can include an umbilical made of coiled tubing and/or sized for insertion into an existing drill stem. The umbilical can include a diluent carrying conduit. The system may also include at least one power cable carrying power to a lower portion of the umbilical, and/or an electric heater powered via the at least one power cable and/or positioned to heat diluent flowing from the diluent carrying conduit.

BRIEF DESCRIPTION OF THE DRAWINGS

Illustrative embodiments of the present invention are described in detail below with reference to the following drawing figures.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
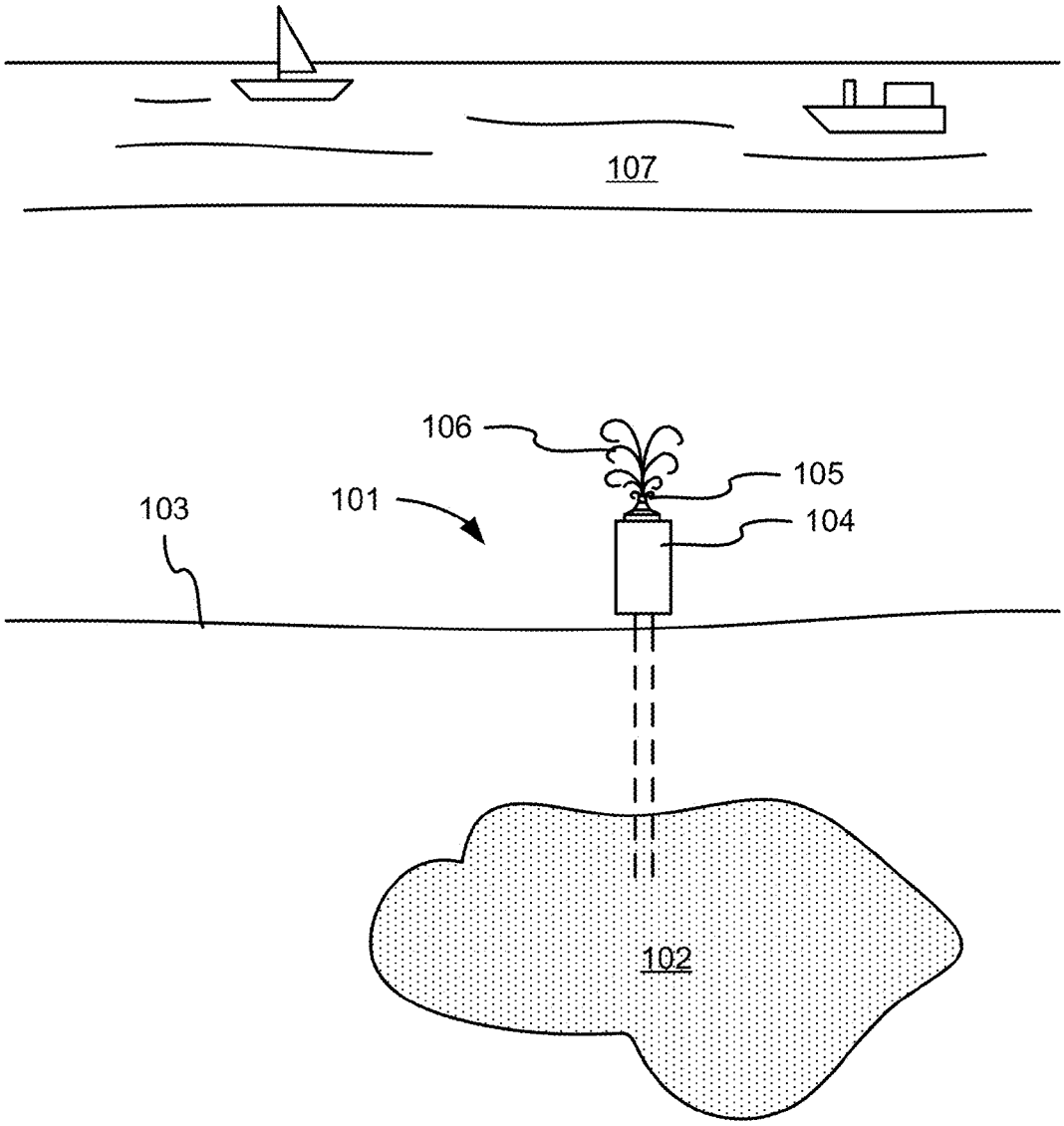
FIG. 1 illustrates a simplified view of an undersea well in a state of uncontrolled release.

FIG. 1 illustrates a simplified view of an undersea well 101 in a state of uncontrolled release. The release may occur for any number of reasons. For example, the release may be due to equipment failure after the well 101 has penetrated a high-pressure oil-bearing reservoir 102 beneath the seafloor 103. In the example of FIG. 1, a blowout preventer (BOP) stack 104 is still in place over well 101, and a riser 105 above BOP stack 104 has been cut so that a length of riser 105 protrudes above BOP stack 104. There are various other configurations of a well in a state of uncontrolled release. Crude oil and other products are escaping as effluent 106 from well 101 into the ocean. Effluent 106 may rise and spread on the ocean surface 107.

Figure 2:
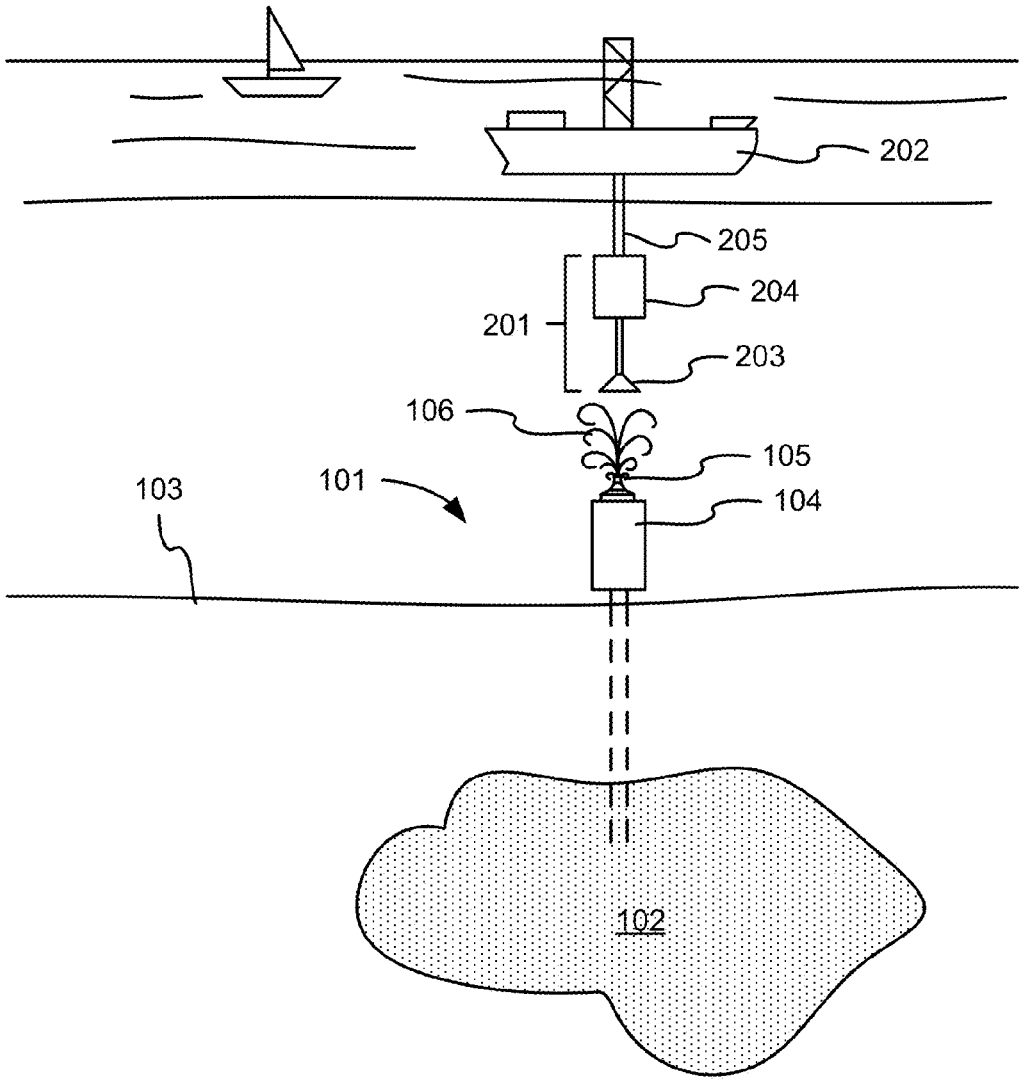
FIG. 2 schematically illustrates placement of a lower marine riser package cap system over the undersea well of FIG. 1 according to some embodiments of the invention.

A previous technique for capturing at least some of the effluent 106 involved placement of a lower marine riser package cap (LMRP cap) over well riser 105. FIG. 2 schematically illustrates placement of an LMRP cap system 201 using a conventional drillship 202. LMRP cap system 201 includes a funnel-like LMRP cap 203 and other equipment 204, and is lowered from drillship 202 in a manner similar to the way drilling equipment is lowered into a well. Sections of pipe 205 are assembled one at a time as LMRP cap system 201 is lowered.

Once LMRP cap 203 is in place, at least some of effluent 106 is captured and travels up pipe 205 to a collection reservoir aboard drillship 202. Liquids may be collected, and natural gas may be flared off.

The operation of LMRP cap 203 is complicated by the remoteness of undersea well 101, by the conditions at sea floor 103, and by the interactions between the components of effluent 106 and the surrounding seawater.

For example, effluent 106 may exit well under intense pressure and at a temperature of about 60° C. (140° F.). At an ocean depth of approximately 1524 meters (5,000 feet), the hydrostatic pressure of seawater is about 150 bar (about 2,200 pounds per square inch). The water temperature at the seafloor may be about 4° C. (39° F.). If effluent 106 is allowed to contact seawater at these conditions, ice-like crystals of methane hydrates may form. These crystals are often called simply "hydrates". If hydrates are allowed to form during the use of LMRP cap 203, pipe 205 may be plugged and the collection of effluent 106 frustrated.

Figure 3:
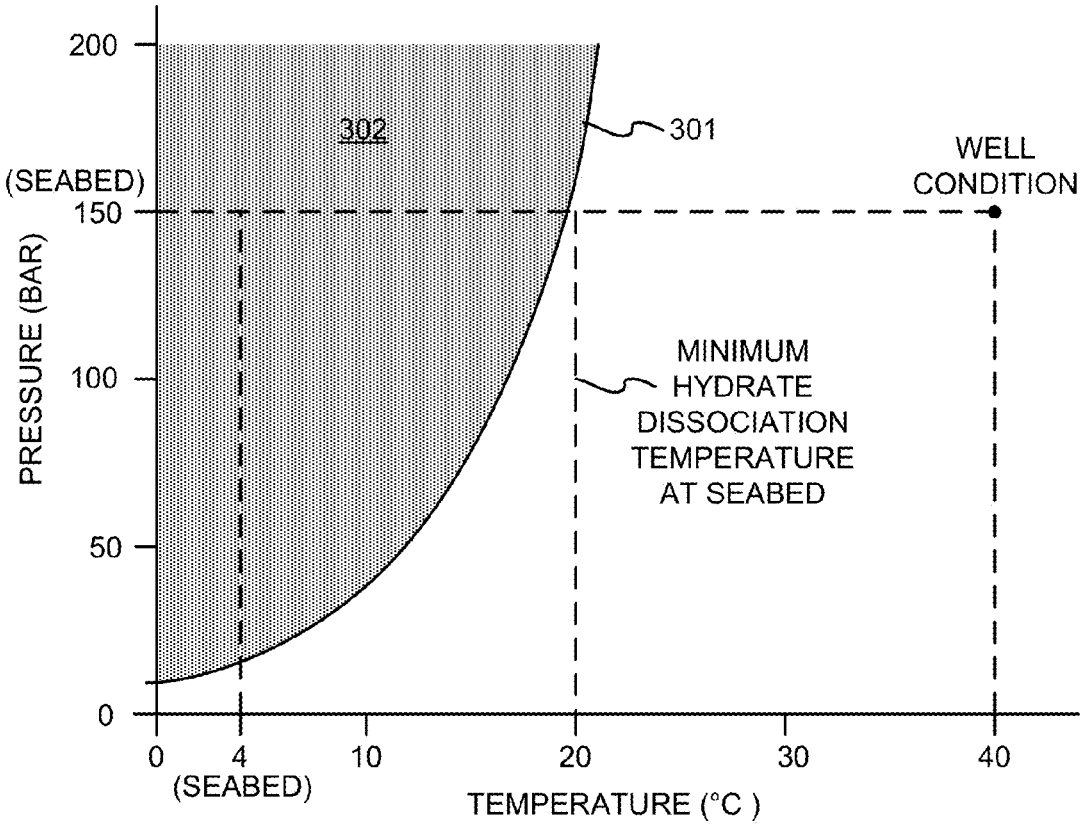
FIG. 3 illustrates a hydrate dissociation curve.

FIG. 3 illustrates a hydrate dissociation curve 301, showing the temperature and pressure conditions under which hydrates will form. For combinations of temperature and pressure above and to the left of hydrate dissociation curve 301, within hydrate envelope 302, hydrates will form when methane comes in contact with seawater. For combinations of temperature and pressure below and to the right of hydrate dissociation curve 301, hydrates will not form. Moreover, crystalline hydrates will dissociate into liquid water and gaseous methane in conditions outside of hydrate envelope 302. The particular well operating conditions marked in FIG. 3 are merely examples, and it will be understood that embodiments of the invention may be utilized at wells in other operating conditions.

In order to maintain the flow of effluent 106 through pipe 205 the effluent can be maintained at temperature and pressure combinations outside of the hydrate envelope and/or significant contact between effluent 106 and seawater can be maintained. In some cases, where hydrates have already formed, it may also be necessary to dissociate any hydrates that block valves, piping, or tubing needed for effluent removal. Because seawater is a nearly infinite heat sink and the seawater surrounding LMRP cap 203 is most likely cold, maintaining effluent 106 at satisfactory temperature and pressure combinations can be challenging. LMRP cap 203 may be heated, for example by pumping heated fluids from drillship 202. To further discourage the formation of hydrates and to mitigate the effects of other precipitates that may form from effluent 106, one or more diluents such as methanol may also be pumped into LMRP cap 203 to mix with effluent 106. For example, tars, asphaltenes, or other precipitates may form from effluent 106, and may be at least partially dissolved or dissociated by the diluents.

Figure 4:
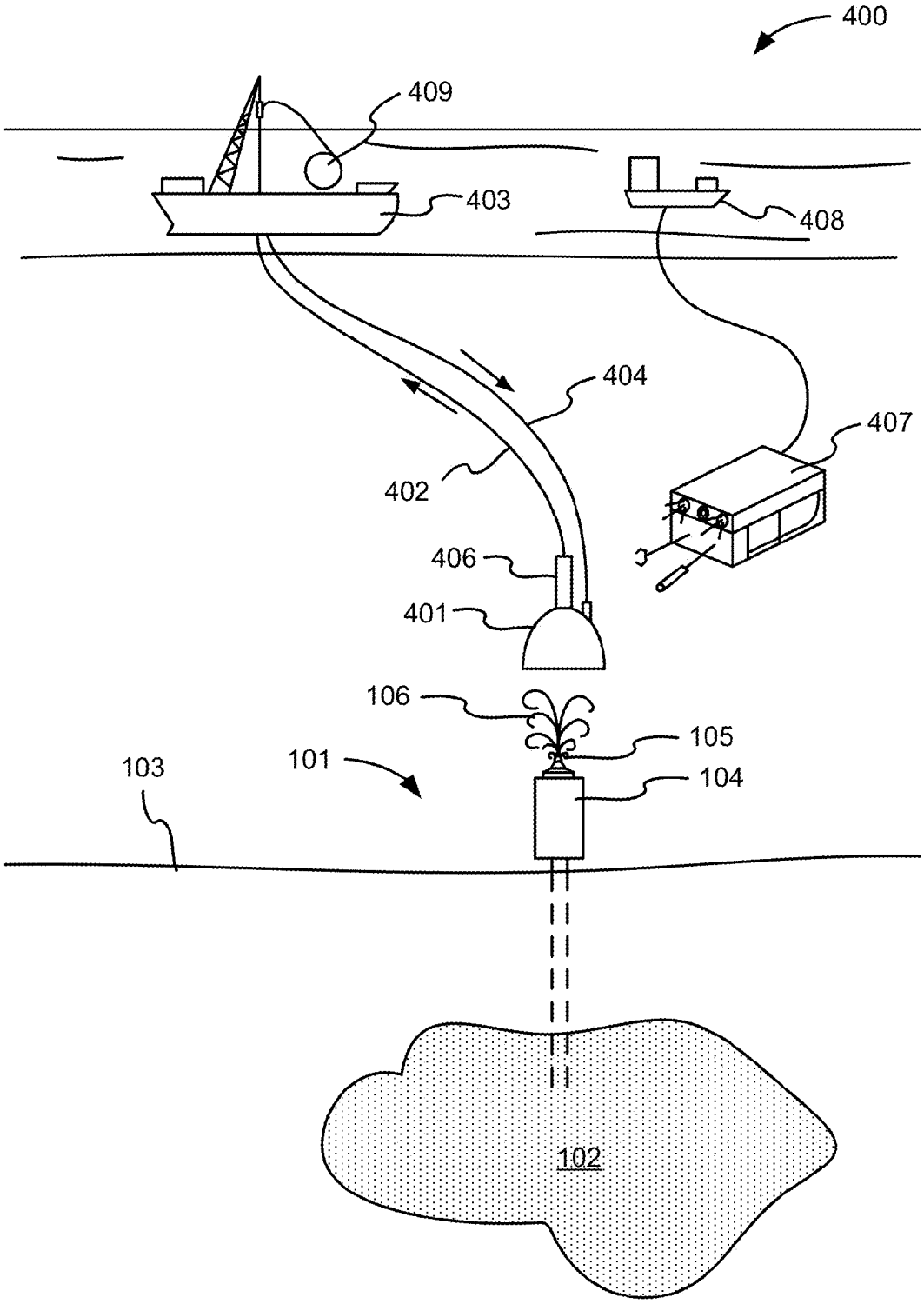
FIG. 4 illustrates a system in accordance with embodiments of the invention for capturing effluent from an undersea well that is in a state of uncontrolled release according to some embodiments of the invention.

FIG. 4 illustrates a system 400 in accordance with embodiments of the invention for capturing effluent from an undersea well that is in a state of uncontrolled release. System 400 includes a submersible isolation bell 401 configured to engage with riser 105, BOP stack 104, or other structure at the top of well 101 near seafloor 103. System 400 also includes an umbilical 402 connected to submersible isolation bell 401. An umbilical is an elongate line or tube that carries electrical power, fluid, control signals, or other services or combinations of services.

Umbilical 402 includes a collection conduit that may be made of coiled tubing (CT) for carrying oil and other products from well 101 to a collection station, for example aboard a support vessel 403. Coiled tubing is used for various purposes in the drilling field, and can be any continuously-milled tubular product manufactured in lengths that require spooling onto a take-up reel or spool such as spool 409 during manufacturing. Coiled tubing may be manufactured in lengths of up to 40,000 feet or more. Coiled tubing may be transported to a wellsite in its coiled state, and at least partially straightened before being deployed into service. Upon being taken out of service, the coiled tubing may be wound back onto a spool. Most coiled tubing is made of metal, for example low-alloy high strength carbon steel, although other metals, plastics, and/or composites can be used.

When umbilical 402 is constructed using coiled tubing, it can be deployed and recovered relatively quickly, as compared with pipe 205. Submersible isolation bell 401 and/or umbilical 402 can be prefabricated and held at the ready in a region where undersea drilling is taking place. If an uncontrolled release incident occurs, system 400 can then be transported a relatively short distance to the wellsite and deployed to begin capture of effluent from the well soon after any wellsite preparations and construction of any required fittings are complete.

Should the initial deployment be unsuccessful, system 400 can be retracted and redeployed relatively quickly by coiling umbilical 402 back aboard support vessel 403, modifying equipment at submersible isolation bell 401, and lowering submersible isolation bell 401 back to well 101.

In other embodiments, an umbilical utilizing drill pipe may also be used. For example, submersible isolation bell 401 may be attached to drill pipe 205 and may be deployed in much the same way as LMRP cap 203 described above Submersible isolation bell 401 and related equipment may be stored on drillship 202 in case of a need for rapid deployment. While the embodiments described herein are illustrated as using coiled tubing any type of tubing can be used.

System 400 further comprises at least one power cable for transmitting electrical power to submersible isolation bell 401. In previous efforts to prevent hydrate formation, systems have provided heat at the wellhead by pumping heated fluids from the ocean surface to the wellhead. This prior method may result in significant heat loss as the heated fluids may cool during the trip to the wellhead. Systems in accordance with embodiments of the invention transmit energy to the wellhead area in the form of electricity, which can then be used to generate heat locally at submersible isolation bell 401, and may also be used for other purposes as described in more detail below. Heated fluids may still also be pumped from the surface, if desired. A conductor or multiple conductors may be integrated within umbilical 402, or may be provided in a separate cable or umbilical.

It may be possible to heat diluents or other fluids present at submersible isolation bell 401 to higher temperatures using local electric heating than would be possible using heated fluid pumped from the surface. Because of the elevated pressures present near sea floor 103, higher temperatures may be reached using local heating without causing boiling of fluids. In addition, heat losses occurring during fluid transfer from the surface may be reduced.

System 400 may also include a diluent carrying conduit 404, which may be integrated with umbilical 402 or may be provided in a separate umbilical, as shown in FIG. 4. Diluents carried by diluent carrying conduit 404 may include methanol, diesel fuel, a combination of methanol and diesel fuel, or any other kind of diluent. In some embodiments, the combination of diesel and methanol can vary, for example, the combination can include 10%, 20%, 30%, 40%, 50%, 60%, 70%, 80%, or 90% diesel by volume or mass. In some embodiments, multiple conduits can be used to carry different diluents. For example, two conduits can be used: a first conduit can carry diesel and a second conduit can carry methanol. These separate conduits can be used, for example, to keep the combined diluents from combusting within the conduit. Moreover, in some embodiments, conduit 404 can include valves near or at bell 401 that can stop both the flow of diluent to bell 401 and/or to restrict combustion from proceeding from bell 401 to support vessel 403. Furthermore, bell 401 can include combustion sensors that can be used to close the conduit valves or that may change the diluent delivered in these conduits to a combustion suppressing substance or may allow combustion suppressing substance to enter bell 401 in the event of combustion.

One or more integral electric heaters may also be included within or near diluent carrying conduit 404, powered by the umbilical electric power cable. Moreover, in some embodiments, the diluents may be heated at the surface prior to being carried through diluent carrying conduit 404.

In some embodiment, umbilical 402 may further include various electrical cables for powering and/or communicating with sensors or other equipment at submersible isolation bell 401. Other kinds of service carrying lines may also be provided, for example one or more fiber optic lines may carry data such as images or video from submersible isolation bell 401 to support vessel 403. An electric submersible pump 406 may also be included at submersible isolation bell 401, for assisting in lifting the captured effluent through the collection conduit to support vessel 403.

In some embodiments, umbilical 402 may be insulated along at least part of its length, to help maintain the temperature of fluid carried in umbilical 402, for instance, to further discourage the formation of hydrates. One or more integral electric heaters may also be included within or near umbilical 402, and can be powered by the umbilical electric power cable. Such an integral electric heaters may also extend along the length or portions of the length of the umbilical.

Installation and operation of system 400 can be assisted by one or more remotely operated vehicles 407, which may be operated from support vessel 403 or from another tender vessel 408. Support vessel 403 may also carry equipment for handling coiled tubing, one or more generators for generating electric power, and other equipment beneficial to the operation of system 400.

Figure 5:
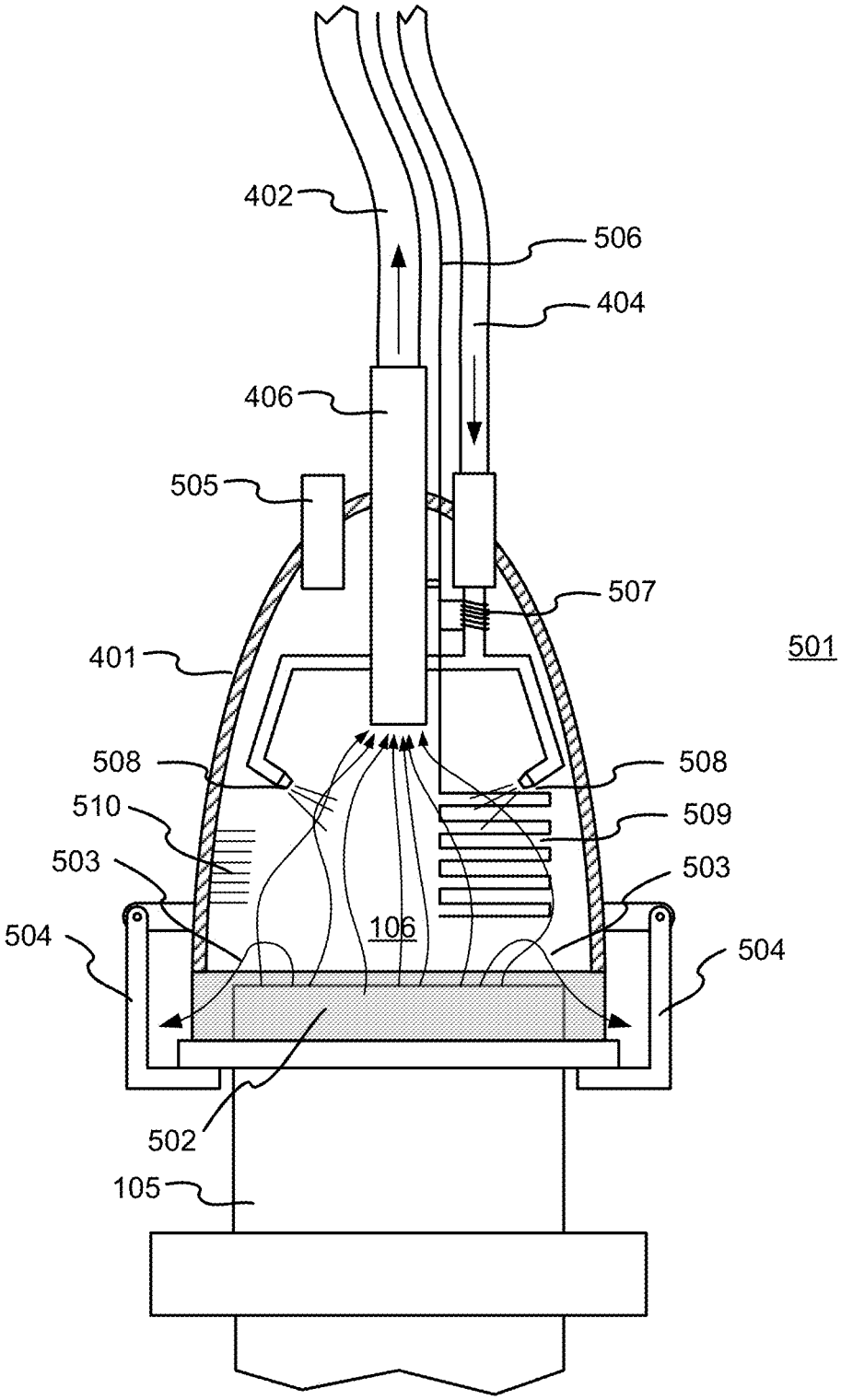
FIG. 5 illustrates a cross section view of a submersible isolation bell, in accordance with embodiments of the invention.

FIG. 5 illustrates a cross section view of submersible isolation bell 401 in more detail, in accordance with embodiments of the invention. In FIG. 5, submersible isolation bell 401 is shown in place over riser 105 and in operation.

Submersible isolation bell 401 can be made of a strong material, for example a steel alloy, and may be weighted for additional stability, and may include chambers that can admit and expel sea water to further control the buoyancy of submersible isolation bell 401. Submersible isolation bell 401 can be configured to engage with a severed riser 105 or another structure at the wellhead, to substantially inhibit the flow of effluent 106 outside of submersible isolation bell 401. The interior of submersible isolation bell 401 can be kept at a positive pressure in relation to the surrounding ocean, to inhibit the uptake of cold surrounding seawater 501 that may encourage the formation of hydrates. Submersible isolation bell 401 may also be thermally insulated, to inhibit heat loss to the surrounding seawater 501.

Sealing measures may be implemented to further isolate the interior of submersible isolation bell 401 from the surrounding seawater 501. For example, a conformable seal or gasket 502 may be placed between submersible isolation bell 401 and riser 105 or other structure. In some embodiments, seal or gasket 502 may be made of a highly conformable open cell foam that may be non-buoyant and semi-permeable. Seal or gasket 502 can be used so that a small portion of effluent 106 can be continually exhausted from submersible isolation bell 401, as shown at 503, to help ensure that surrounding seawater 501 is not admitted into submersible isolation bell 401. Seal or gasket 502 can be porous to allow effluent 106 to escape into surrounding seawater 501. Seal or gasket 502 may be, for example, made of a TEMBO® foam available from Composite Technology Development, Inc., of Lafayette, Colo., USA. Seal or gasket 502 and other fittings may be fabricated case-by-case for particular well installations, as the size, shape, degree of damage, and other aspects of the equipment remaining at sea floor 103 may vary from well to well. A fastening mechanism 504 may be provided for securely attaching submersible isolation bell 401 to the well structure, and may also be fabricated to fit a particular well situation. While fastening mechanism 504 is shown as two L-shaped latches that can be deployed to engage with a convenient part of riser 105 assembly or parts of BOP stack 104, any suitable fastening system may be used, for example pins, hooks, bolts, or other kinds of fasteners or combinations of fasteners.

One or more closeable vents 505 may be provided for venting submersible isolation bell 401 during installation. Closeable vents 505 can be closed once submersible isolation bell 401 is in place, to further contain effluent 106.

Additional connections may be provided for attaching additional umbilicals to submersible isolation bell 401, for example to carry additional solvents or diluents to submersible isolation bell 401, to carry additional effluent 106 to support vessel 403 or another vessel, to carry additional power or signals, or for other purposes.

Electric power may be generated aboard support vessel 403 and supplied by power cable 506 for various purposes at submersible isolation bell 401. For example, electric submersible pump 406 may be powered using power from power cable 506. Diluent or other fluids supplied through diluent carrying conduit 404 may be heated, for example using heater 507 (e.g., electrical and/or resistance heater) or other means, so that diluents introduced into submersible isolation bell 401, from nozzle 508, are heated to enhance their effectiveness and to further discourage the formation of hydrates and the precipitation of other by products.

Additional heat may also be introduced generally into the interior of submersible isolation bell 401 using heater 509 (e.g., electrical and/or resistance heater) or other means. Fins 510 or other structures may be provided to assist in dispersion of heat within submersible isolation bell 401. Heater 509 or similar heaters maybe especially useful for startup of the system, to prevent formation of hydrates during the installation of submersible isolation bell 401.

Electric power may be utilized for other purposes as well, for example, for closing closable vents 505, powering any sensors or communications equipment present at submersible isolation bell 401, or for other purposes. The amount of power supplied for heating, for example by heaters 507 and/or 509, may be controllable in response to temperature measurements made at submersible isolation bell 401. For example, sufficient power may be supplied to keep the conditions within submersible isolation bell and umbilical 402 well outside of hydrate envelope 302.

Figure 6:
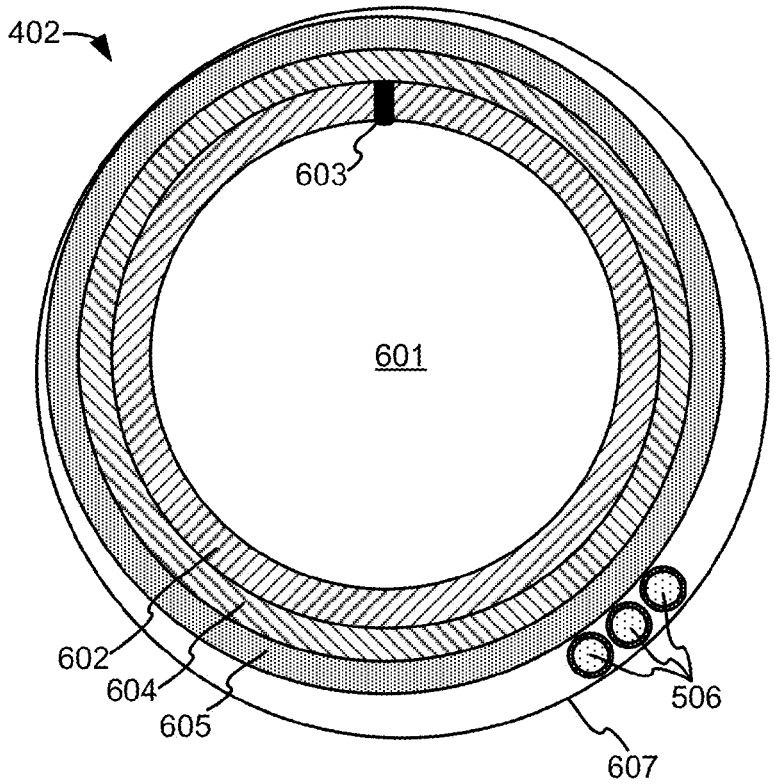
FIG. 6 illustrates a cross section view of an umbilical in accordance with embodiments of the invention according to some embodiments of the invention.

FIG. 6 illustrates a cross section view of umbilical 402, in accordance with embodiments of the invention. Oil flow cross section 601 is the main channel of umbilical 402 and can be used to allow oil, effluent and/or other material to flow there through. Umbilical 402 can be surrounded by coiled tubing 602, which can be welded at weld 603. Coiled tubing 602 may be of any size useful for carrying oil and deployable from support vessel 403 to typical ocean depths. For example, equipment exists for handling coiled tubing in diameters up to at least 6.5 inches or more. Such tubing may be available in lengths of several thousand feet. Coiled tubing 602 may in turn be surrounded by heater 604 of any suitable type, and thermal insulation 605. Power cable 506, shown as comprising three insulated conductors may be affixed using clamp 607 (e.g., cable clamp) or similar device. Power cable 506 could also comprise a different number of conductors, for example two conductors.

Figure 7:
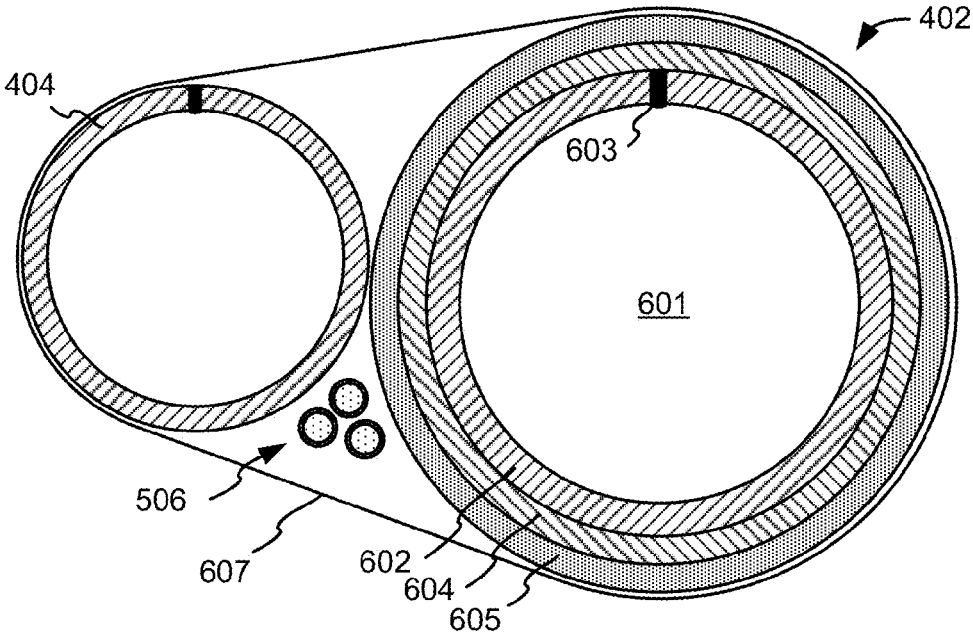
FIG. 7 illustrates a cross section view of a combined umbilical according to some embodiments of the invention.
Figure 8:
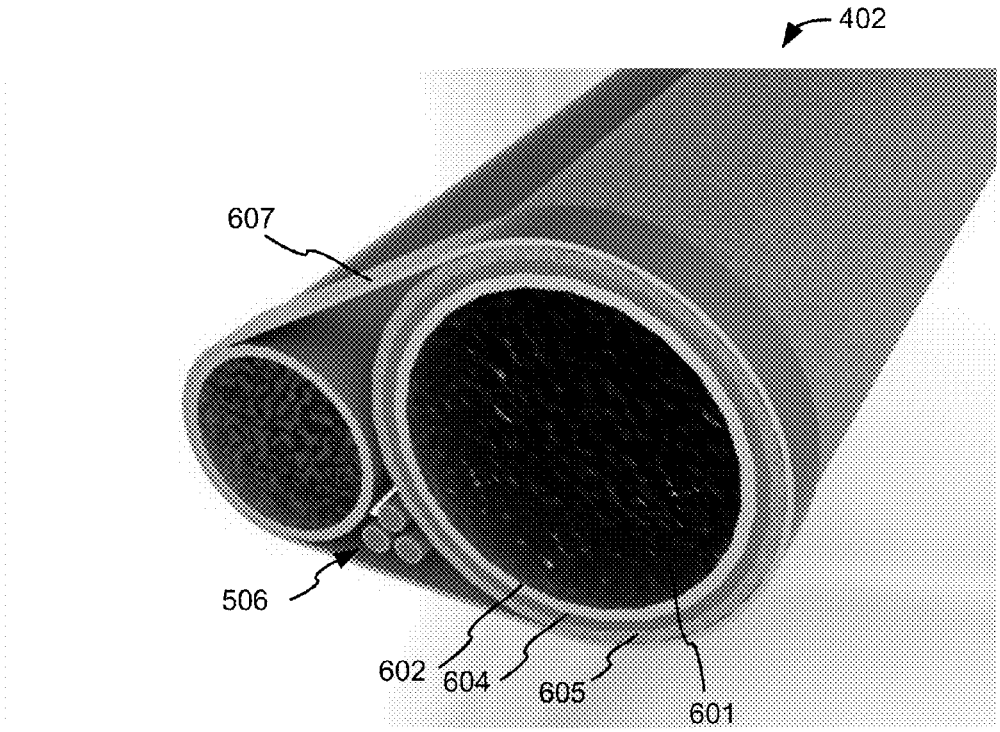
FIG. 8 shows a combined umbilical with clamps according to some embodiments of the invention.
Figure 9:
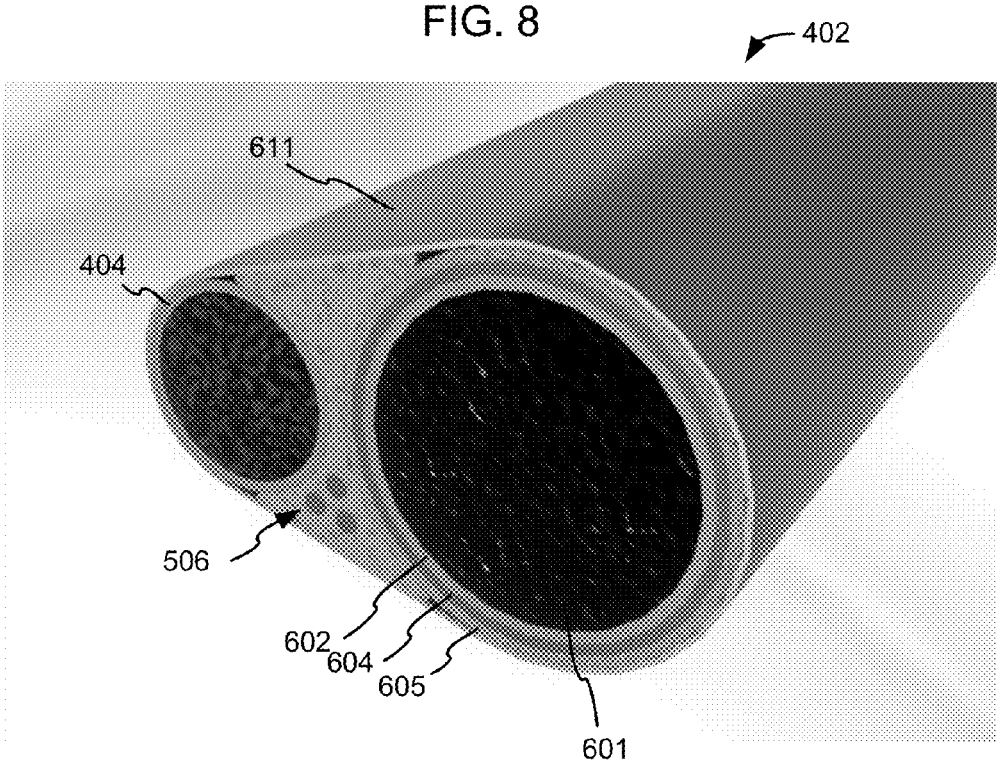
FIG. 9 shows a combined umbilical with an outer tube according to some embodiments of the invention.

In some embodiments, umbilical 402 may be combined with other structures, enabling simultaneous deployment from support vessel 403. For example, FIG. 7 illustrates a cross section view of a combination of umbilical 402, diluent carrying conduit 404, and power cable 506, connected by clamp 607. FIGS. 8 & 9 show examples of a combined umbilical that includes umbilical 402, diluent carrying conduit 404, and power cables 506. In some embodiments, multiple clamps 607, such as those designed for use on riser tubes, may be placed at intervals along the length of an umbilical and can be used to couple the various conduits, umbilicals, cables, cords, etc. In such embodiments, there may be no need for clamp 607.

In other embodiments, all the umbilical components (and possibly other components) may be disposed within an outer umbilical 611 that is continuous or mostly continuous (e.g., with a handful of breaks) tube that extends from support vessel 403 to effluent 106 and/or well 101. FIG. 9 shows an example of such an umbilical. Such umbilicals may be fabricated by the techniques described in co-pending U.S. patent application Ser. No. 13/177,368, filed Jul. 6, 2011, and titled "Coiled Umbilical Tubing", previously incorporated by reference.

Figure 10:
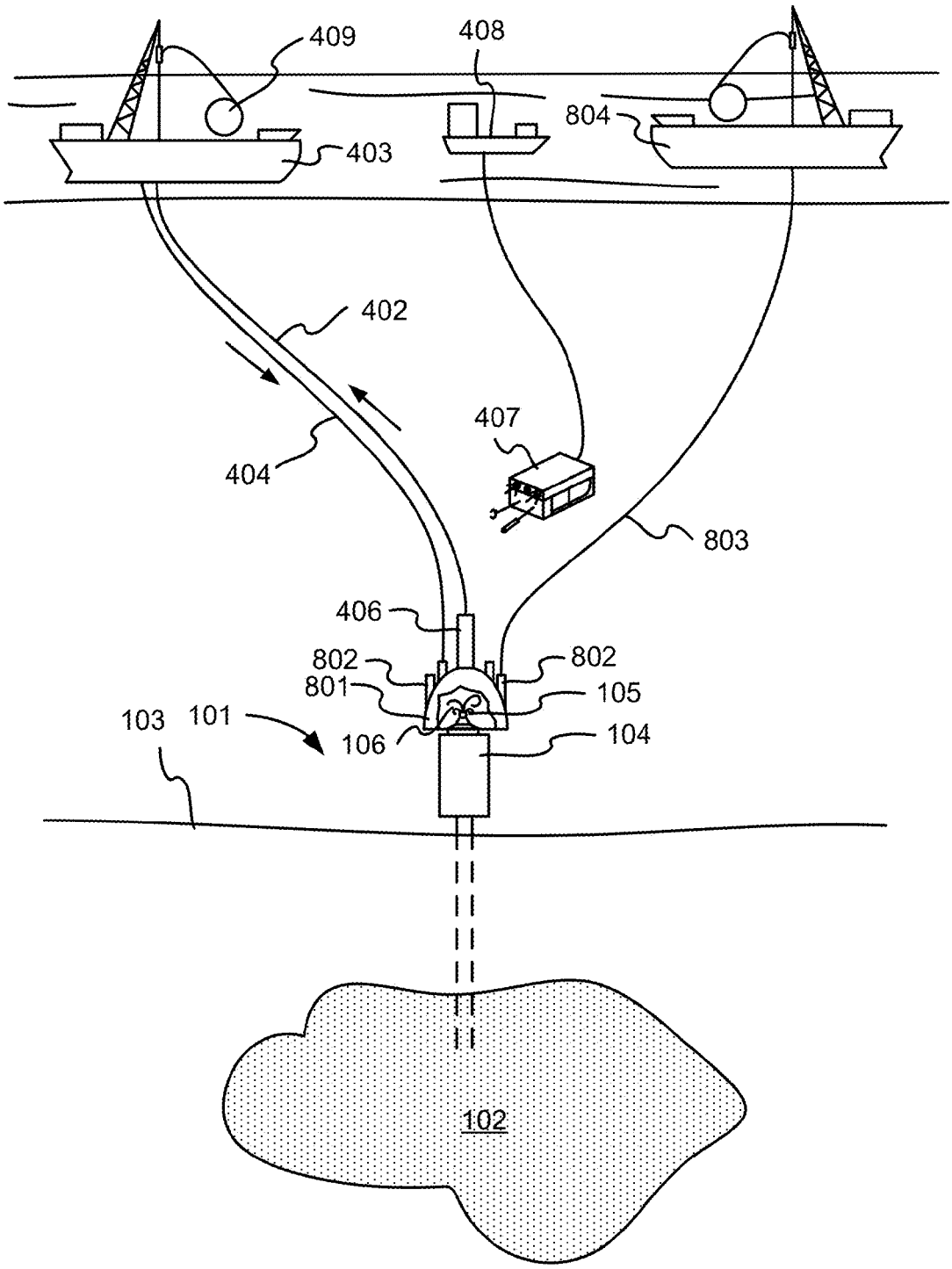
FIG. 10 illustrates a submersible isolation bell with multiple connection points, in accordance with embodiments of the invention.

In other applications, a submersible isolation bell in accordance with embodiments of the invention may include additional connection points for additional umbilicals, cables, conduits, or other structures, which may be deployed from one or multiple support vessels. By way of example, FIG. 10 shows a submersible isolation bell 801 with multiple connection points 802. In the illustrated arrangement, an additional umbilical 803 is connected to one of connection points 802, and is deployed from a second support vessel 804. Additional umbilical 803 may carry oil or other effluent from well 101 to second support vessel 804, may provide additional electric power to submersible isolation bell 801, may carry signals to and from additional sensors placed at submersible isolation bell 801, and/or may provide other support to the operation to recover effluent 106 from well 101. Additional umbilical 803 may perform a combination of functions.

Figure 11:
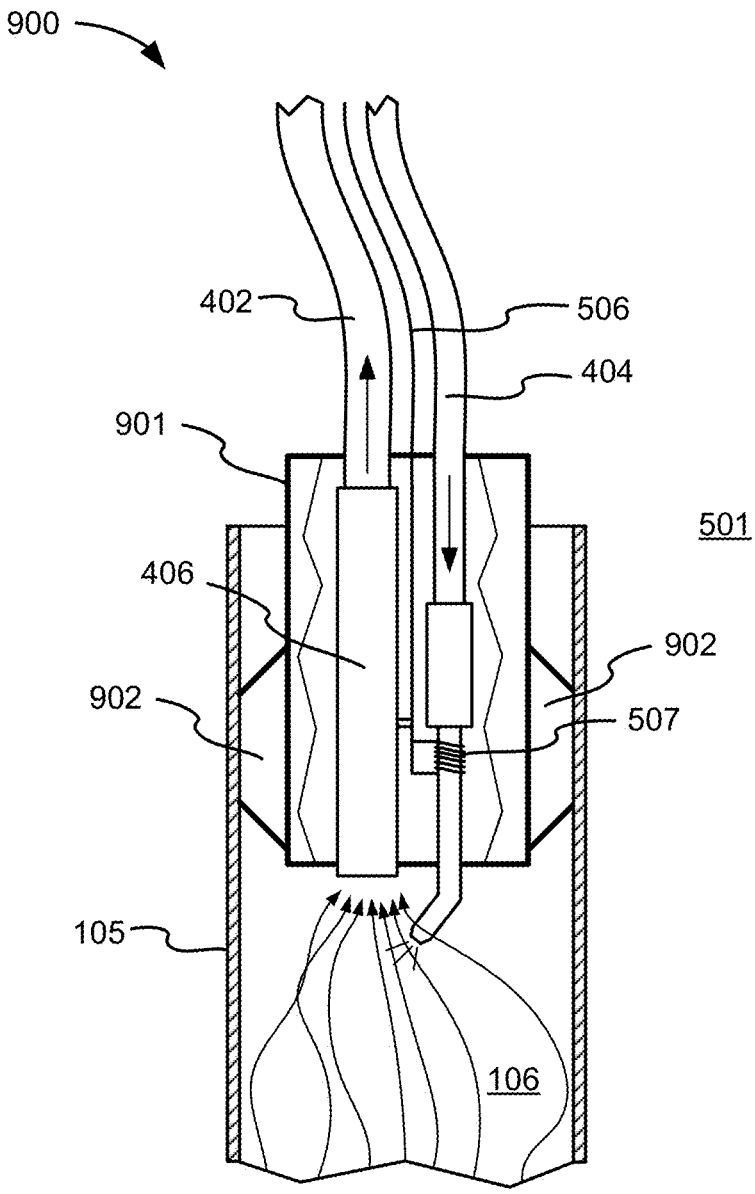
FIG. 11 illustrates a well servicing system according to other embodiments.

FIG. 11 illustrates a portion of a well servicing system 900 according to other embodiments. System 900 may be deployed in a manner similar to system 400 and may provide similar features and benefits, but connects differently to the wellhead equipment. In other embodiments, system 900 may be used to unclog a pipe or well. System 900 includes umbilical 402 and fitting 901 that can connect to the lower end of umbilical 402. To unclog pipes or wells, umbilical 402 can be fed into a clogged pipe or well through riser 105.

Umbilical 402 can include a collection conduit for carrying effluent from the well to a collection station, and/or at least one power cable 506. Fitting 901 can be sized to fit within a piece of equipment at the wellhead, for example riser 105. Fitting 901 can be a standard or custom fitting that is designed to fit with a specific riser, pipe or well. Fitting 901 may also comprise a seal 902 configured to deploy at the wellhead to substantially prevent effluent 106 from escaping the well other than through the collection conduit of umbilical 402. For example, seal 902 may be mechanically expandable or hydraulically inflatable to substantially seal against the inner wall of riser 105. Moreover seal 902 may also act as a centralizer that, for example, centers fitting 901 or umbilical 402, pump 406, conduit 404, or a combination of these within riser 105.

A diluent carrying conduit 404 may also be provided, for carrying diluent to the well, for example from support vessel 403. Either or both of umbilical 402 and diluent carrying conduit 404 may be made of coiled tubing and deployed by uncoiling the coiled tubing from a spool as fitting 901 is lowered to the well. Alternatively, system 900 may be implemented using conventional drill pipe.

Heater 507 may be provided, drawing its power from power cable 506. Heater 507 can be positioned to heat diluent supplied via diluent carrying conduit 404 near a lower end of umbilical 402. The heated diluent may mix with effluent 106 to heat effluent 106 to prevent the formation of hydrates before or while effluent 106 travels through the collection conduit of umbilical 402. System 900 thus provides local heating of effluent 106, and may be able to reach higher temperatures than would be achievable by piping pre-heated diluent from the ocean surface.

Electric submersible pump 406 may also be provided, to assist in lifting effluent 106 through the collection conduit to the collection station. Electric submersible pump 406 may be powered via power cable 506.

Figure 12:
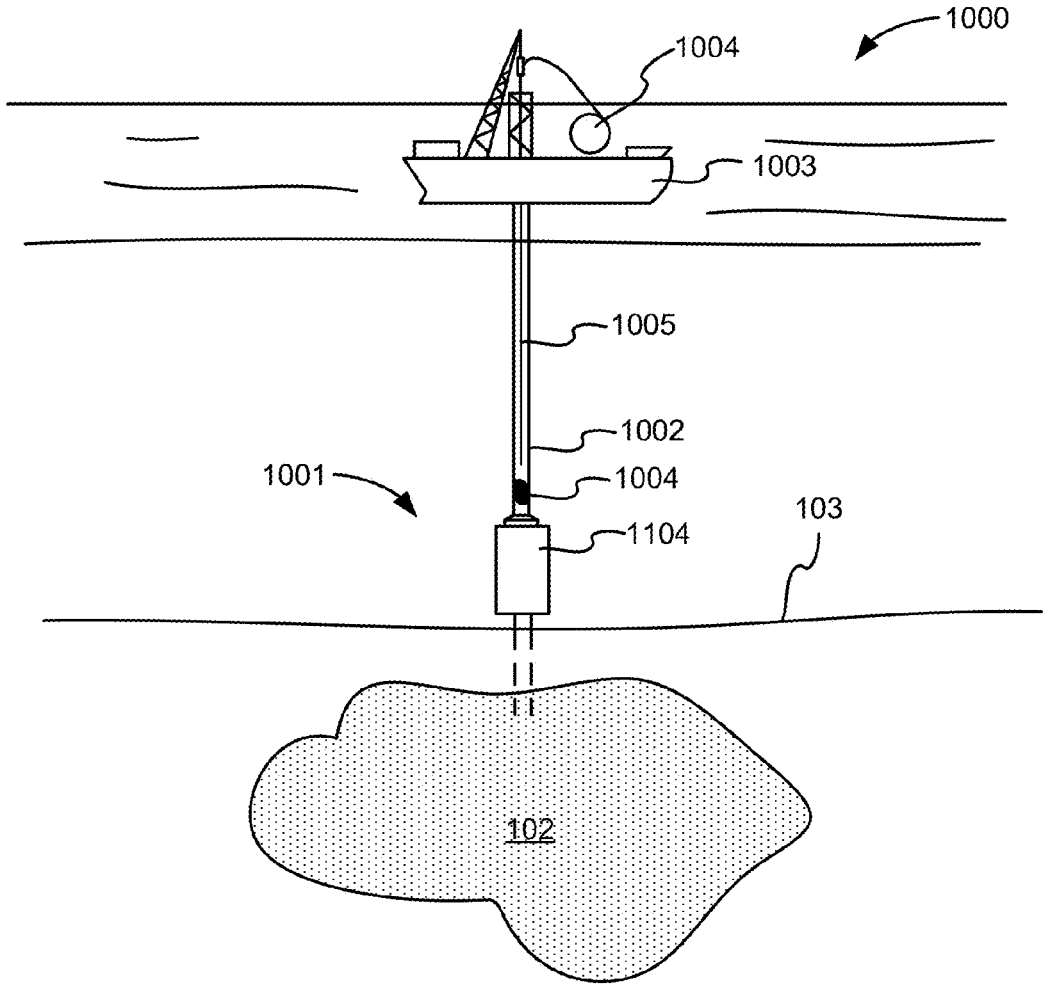
FIG. 12 illustrates a well servicing system in according with some embodiments of the invention.
Figure 13:
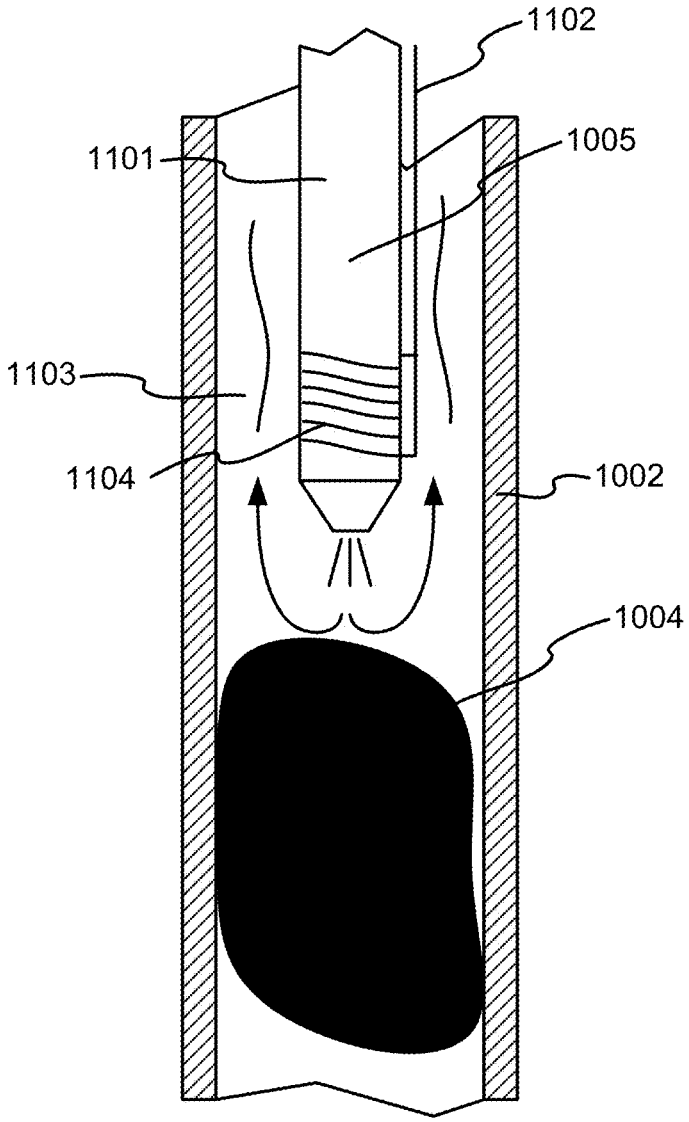
FIG. 13 illustrates a detailed view of a portion of the system of FIG. 12 according to some embodiments of the invention.

FIGS. 12 and 13 illustrate a system 1000 according to some embodiments of the invention. System 1000 may be useful, for example, for intervening in the case of a well 1001 whose integrity has not been breached, but that is clogged or otherwise affected by the formation of hydrates within drill pipe 1002.

System 1000, for example, includes a drillship 1003 equipped with coiled tubing handling equipment. Drill pipe 1002 is plugged or restricted by a hydrate plug 1004. Hydrate plug 1004 is shown as having formed near the bottom of drill pipe 1002, near BOP stack 104, but such a plug may form in other locations as well.

In accordance with embodiments of the invention, an umbilical 1005 is made at least in part of coiled tubing, and is uncoiled from a spool and lowered into drill pipe 1002. The lower end of umbilical 1005 is shown in more detail in FIG. 13. Umbilical 1005 can be sized for insertion in drill pipe 1002, and can include a diluent carrying conduit 1101 and at least one power cable 1102 that carries power to the lower portion of umbilical 1005. Electric heater 1104 can draw power from power cable 1102, and can be positioned to heat diluent flowing from diluent carrying conduit 1101. The heated diluent can dissolve or otherwise dissociate hydrate plug 1004, whose residue is carried by the flowing diluent back up the annular space between umbilical 1005 and drill pipe 1002.

Once hydrate plug 1004 has been removed, umbilical 1005 can be removed from drill pipe 1002 and normal operations may be resumed.

While electric heater 1104 is shown in FIG. 13 as being disposed over a small portion of umbilical 1005 near lower end 1103, and electric heater 1104 are shown as being on the outside of umbilical 1005, other arrangements are possible. For example, electric heater 1104 may extend over all or a significant portion of the length of umbilical 1005, to gradually heat diluent in diluent carrying conduit 1101 on its way to lower end 1103 of umbilical 1005. Also, both power cable 1102 and electric heater 1104 could be inside the outer casing of umbilical 1005. Methods of constructing such an umbilical are described in co-pending U.S. patent application Ser. No. 13/177,368, filed Jul. 6, 2011, and titled "Coiled Umbilical Tubing", previously incorporated by reference.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A well servicing system, comprising:

a submersible isolation bell;

an umbilical connected to the submersible isolation bell, the umbilical further comprising a collection conduit for carrying effluent from the well to a surface collection station;

a power cable for transmitting electrical power to the submersible isolation bell;

an electric heater positioned at least in part to heat diluent and the effluent within the submersible isolation bell; and a diluent carrying conduit within the umbilical for carrying diluent to the submersible isolation bell from the collection station, wherein a combination of temperature and pressure is maintained within the isolation bell that is outside a hydrate envelope within the submersible isolation bell.

2. The well servicing system of claim 1, wherein the collection conduit is made of coiled tubing or drill pipe.

3. The well servicing system of claim 1, wherein the electric heater is powered through the power cable.

4. The well servicing system of claim 3, wherein the electric heater is positioned at least in part to supply heat to the interior of the submersible isolation bell.

5. The well servicing system of claim 1, further comprising a conformable seal adapted to substantially seal the submersible isolation bell to a riser.

6. The well servicing system of claim 5, wherein the conformable seal is made of a semi-permeable open cell foam.

7. The well servicing system of claim 1, further comprising an electric submersible pump for lifting collected effluent up the collection conduit, the electric submersible pump being powered through the power cable.

8. The well servicing system of claim 1, further comprising at least one heater coupled to the collection conduit, the heater configured to heat effluent being carried through the collection conduit.

9. A method of servicing an undersea well, the method comprising:

providing a well servicing system that further includes a submersible isolation bell, and an umbilical connected to the submersible isolation bell, wherein the umbilical further includes a collection conduit for carrying effluent from the well to a surface collection station, wherein the umbilical further comprises a power cable for transmitting electrical power to the submersible isolation bell, wherein the well servicing system further comprises an electric heater positioned at least in part to heat diluent and the effluent within the submersible isolation bell, and wherein the well servicing system further comprises a diluent carrying conduit within the umbilical for carrying diluent to the submersible isolation bell from the collection station;

deploying the well servicing system by lowering the submersible isolation bell over the well;

disposing the submersible isolation bell over the well; and maintaining the effluent substantially at a combination of temperature and pressure that is outside a hydrate envelope while the effluent is within the submersible isolation bell.

10. The method of claim 9, wherein the collection conduit is made of coiled tubing, and wherein deploying the well servicing system includes deploying the well servicing system by lowering the submersible isolation bell over the well while uncoiling the umbilical from a spool.

11. The method of claim 9, further comprising collecting effluent from the well and carrying it to the collection station through the collection conduit.

12. The method of claim 11, wherein the method further comprises providing at least one diluent to the submersible isolation bell via the diluent carrying conduit.

13. The method of claim 12, wherein providing at least one diluent to the submersible isolation bell via the diluent carrying conduit comprises either or both methanol or diesel fuel.

14. The method of claim 12, wherein the method further comprises:

supplying electric power to the electric heater via the power cable;

heating the at least one diluent at the submersible isolation bell; and mixing the at least one heated diluent with effluent from the well.

15. The method of claim 9, further comprising heating the interior of the submersible isolation bell using power supplied through the power cable.

16. A well servicing system, comprising:

an umbilical that includes a collection conduit for carrying effluent from the well to a surface collection station, and at least one power cable;

a fitting connected to the umbilical, the fitting sized to fit within a piece of equipment at a wellhead;

a diluent carrying conduit within the umbilical for carrying diluent to the well from the collection station; and an electrical heater powered via the power cable and positioned at least in part to heat the diluent and the effluent near a lower end of the umbilical, wherein a combination of temperature and pressure is maintained near the lower end of the umbilical that is outside a hydrate envelope.

17. The well servicing system of claim 16, wherein the fitting provides a seal configured to deployed at the piece of equipment at the wellhead to substantially prevent effluent from escaping the well other than through the collection conduit.

* * * * *